US006250633B1

(12) United States Patent
Mohtasham et al.

(10) Patent No.: US 6,250,633 B1
(45) Date of Patent: Jun. 26, 2001

(54) BOARD GAME

(76) Inventors: Mani Mohtasham, 1799 Westwind Way, McLean, VA (US) 22102; Hamid Gharagozloo, 7925 SW. 165 St., Miami, FL (US) 33157

( * ) Notice: Subject to any disclaimer, the term of this patent is extended or adjusted under 35 U.S.C. 154(b) by 0 days.

(21) Appl. No.: 09/498,284

(22) Filed: Feb. 4, 2000

Related U.S. Application Data

(60) Provisional application No. 60/118,613, filed on Feb. 4, 1999.

(51) Int. Cl.[7] ..... A63F 3/02

(52) U.S. Cl. ..... 273/261; 273/262; 273/287; 273/255

(58) Field of Search ..... 273/255, 258, 273/260, 261, 262, 287, 267

(56) References Cited

U.S. PATENT DOCUMENTS 429,250 * 5/1890 Sperl .
1,342,884 * 6/1920 Anderson .
1,633,445 * 6/1927 Gail .
2,766,987 * 10/1956 Seelbrede .
3,820,791 * 6/1974 Powers .
3,863,926 * 2/1975 White .
4,277,066 * 7/1981 Hough .
4,300,768 * 11/1981 Wechsler .
4,893,820 * 1/1990 Silverman .
5,236,194 * 8/1993 Mohtasham .
5,660,388 * 8/1997 Benn .

* cited by examiner

*Primary Examiner*—Benjamin H. Layno
*Assistant Examiner*—V. K. Mendiratta
(74) *Attorney, Agent, or Firm*—Robert M. Downey, P.A.

(57) ABSTRACT

A game of skill includes a playing board having a perimeter surrounding a playing area divided into equally sized boxes, wherein each box is marked with an identifying element, such as a geometric shape and/or symbol of a particular color. The identifying elements dictate the permitted direction of movement of corresponding playing pieces along avenues formed by the arrangement of identifying elements within the boxes. Scoring points are indicated at the juncture of four box corners, identifying the center of four adjacently positioned boxes in a square area. The playing pieces are provided in contrasting colors to identify each player. Each player is provided with four sets of playing pieces, the playing pieces in each set being of a particular group to identify the permitted movement of the playing pieces of that group. Each player is further provided with scoring pieces of contrasting color. When a scoring point is surrounded on three sides (i.e., three boxes) by playing pieces from either opponent occupying those boxes, the player who closes the fourth side, i.e., the last of the four boxes, gains the scoring point, and places the scoring piece over the scoring point. The first player to score a predetermined number of points, or more than 50% of the total number of scoring points on the playing board, wins the game.

5 Claims, 6 Drawing Sheets

BOARD GAME

This is a continuation of provisional application Ser. No. 60/118,613 Feb. 4, 1999.

BACKGROUND OF THE INVENTION

1. Field of the Invention

The present invention relates to a game comprising a plurality of player pieces which are placed on a game board divided into a series of boxes or other geometric shapes, wherein a player attempts to score points by moving along predetermined avenues on the playing area and surrounding a plurality of scoring points indicated on the playing area.

2. Discussion of the Related Art

There are numerous types of board games known in the related art. In particular, one type of board game provides a flat playing surface with a plurality of boxes or spaces arranged around a perimeter of the board. Players move playing pieces around the perimeter of the game board based on the number obtained in rolling a die or more than die. This type of game is typically suited for people of all ages and requires little skill, as the luck in rolling the die, which determines spaces each player lands on, contributes to a large extent to the outcome of the game. An example of this type of board game is found under the trademark of "MONOPOLY."

Another type of board game which is more relevant to the present invention provides a flat playing surface with a checkered grid of horizontal rows and vertical columns of squares on the playing surface. Each player is provided with a plurality of playing pieces, and each player takes a turn moving their players in accordance with a strategy to overtake the other player's playing pieces. Examples of this type of game are the well known games of checkers and chess. Another example of this type of game can be found in Reisel, U.S. Pat. No. 5,641,166 and Rumph, U.S. Pat. No. 5,496,037.

The patent to Reisel discloses a board game for two to four players and includes an eight sided game board having a checkered grid of horizontal rows and vertical columns of squares provided on its playing surface, and two types of a plurality of six sided cubic playing pieces positioned on the board. One type of the playing pieces has a first symbol provided on at least one of its six sides to represent a blocking function. The remaining playing pieces have six symbols identifying their six sides. Each different one of these symbols is provided on a different side of their six sides to represent six different functions of these playing pieces. When the playing piece is positioned on the game board with a selected symbol located on the top side, it assumes that particular function. Each function is allowed to move on the checkered grid on the board following the roll of a die or two dice and to capture opponent's playing pieces according to pre-set rules of the game.

The patent to Rumph discloses a battlefield game board which includes a war simulation game for two players. A square game board comprises 12 rows of square boxes forming a grid pattern. A first player set up zone is formed by the first three rows of square boxes and a second player set up zone is formed by the first three rows of square boxes located at an opposite end of the game board. Playing pieces comprise tank playing pieces, soldier playing pieces, and anti-tank gun playing pieces. The playing pieces are moved about the game board in accordance with a chance determining device, in order to remove an opponent player's playing pieces.

While the various board games known in the art, including those described above, have been found to be entertaining and, in some instances, quite challenging, there still remains a need for a board game which presents new challenges and entertainment to players of all ages. More particularly, there is a need for a new board game which provides new and exciting objects of play which have not been previously addressed in the board game art. Moreover, there is a need for a new board game which requires a significant level of skill and intellect to play at a competitive level.

SUMMARY OF THE INVENTION

The present invention is directed to a game of skill. More particularly, the present invention provides a playing board having a perimeter surrounding a playing area, wherein the playing area is divided into equally sized boxes. Each box is marked with an identifying element, such as a geometric shape and/or symbol of a particular color. The identifying elements dictate the permitted direction of movement of corresponding player pieces along avenues formed by the arrangement of identifying elements within the boxes. Scoring points are indicated at the juncture of four corners, identifying the center of four adjacently positioned boxes in a square area. The playing pieces are provided in contrasting colors to identify each player. Each player is provided with four sets of playing pieces, wherein the playing pieces in each set are of a particular group to identify the permitted movement of the playing pieces of that group. Each player is further provided with scoring pieces of contrasting color. When a scoring point is surrounded on three sides (i.e., the three boxes) by playing pieces from either opponent occupying those boxes, the player who closes the fourth side by entering the fourth box surrounding a particular scoring point, gains that scoring point, and places his/her scoring piece over the scoring point. The first player to score a predetermined number of points, of more than 50% of the total number of scoring points on the playing board, wins the game.

BRIEF DESCRIPTION OF THE DRAWINGS

For a fuller understanding of the nature of the present invention, reference should be had to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
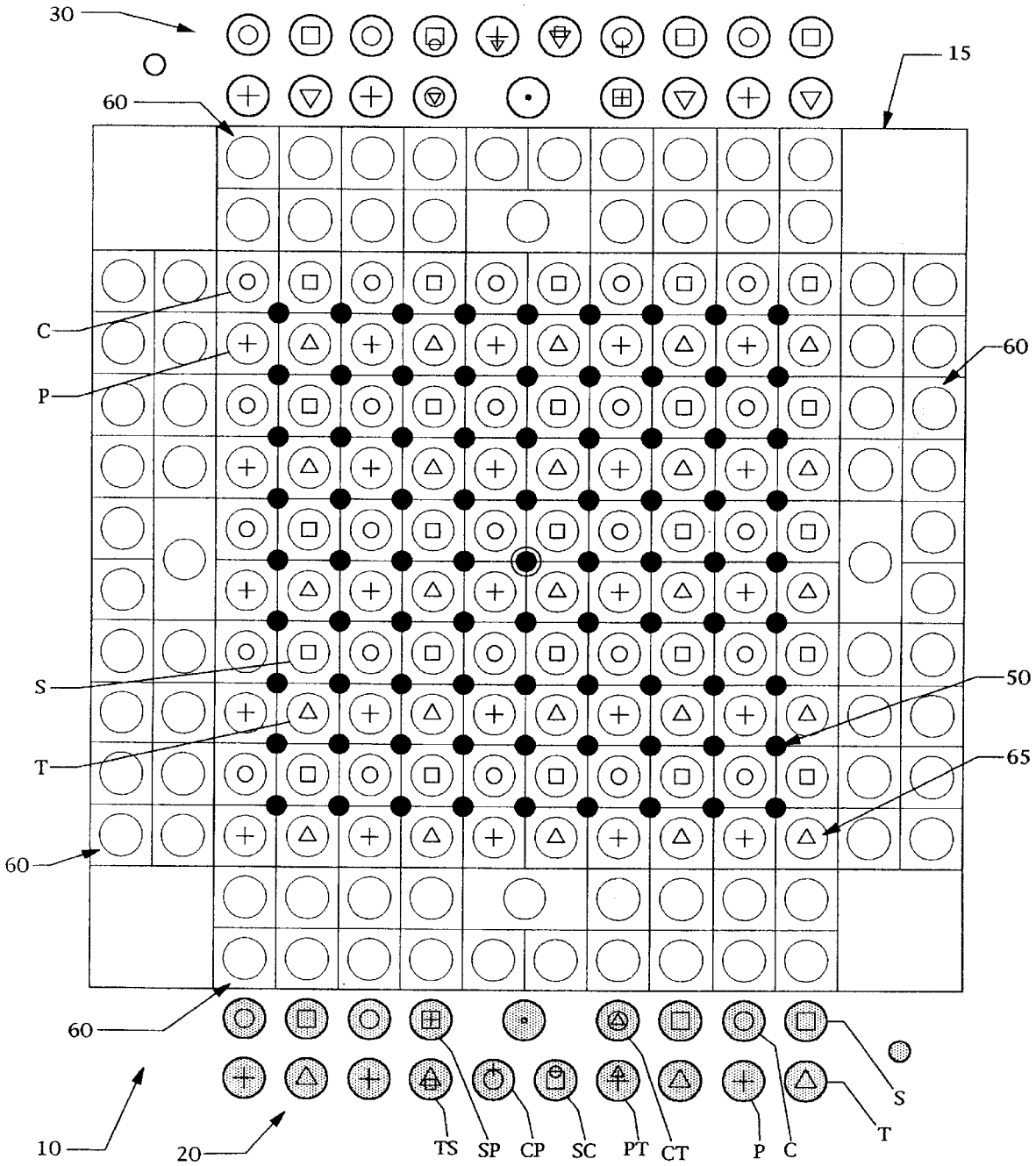
FIG. 1 is a top plan view of the game board and playing pieces, showing the playing pieces separated from the board.
Figure 2:
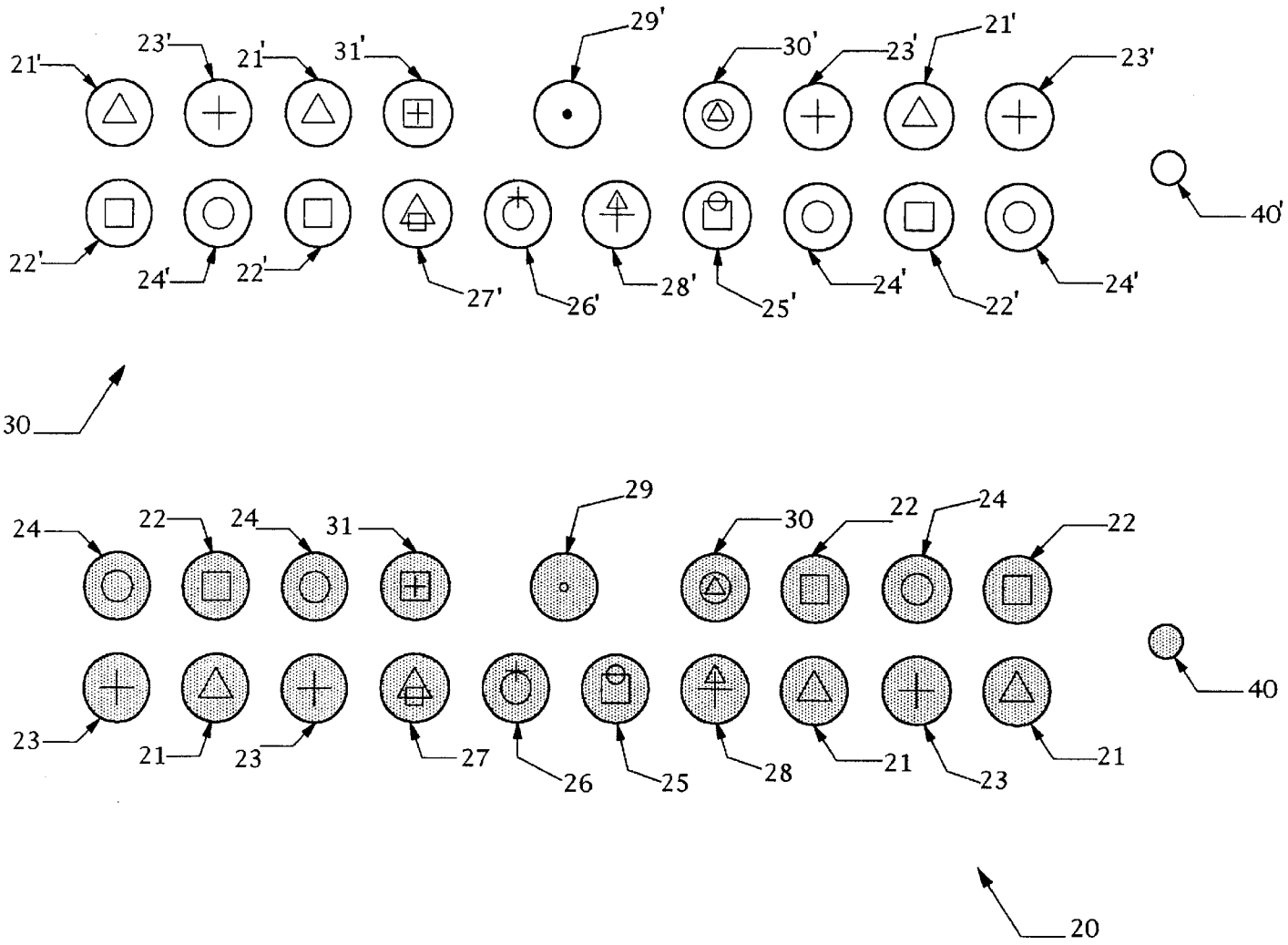
FIG. 2 is a top plan view of the playing pieces.

As seen throughout the drawing figures, the present invention is directed to a game having a board 15. The board includes perimeter 60 and a playing area 65. The perimeter 60 is where players begin the game by setting their playing pieces 20, 30 on the indicated areas. Players have the option of playing the game from either of opposite sides of the square board 15.

In a preferred embodiment, the playing area 65 is divided into 100 equally sized boxes, including ten rows and ten columns of boxes. Each box is marked with one of four different identifying elements. In the preferred embodiment, as shown in the drawings, the identifying elements include a square S, a circle C, a triangle T, and a plus sign P. There are 25 boxes for each of the identifying elements. The identifying elements are used to dictate the direction of movement for corresponding player pieces 20, 30 for each player.

Figure 3:
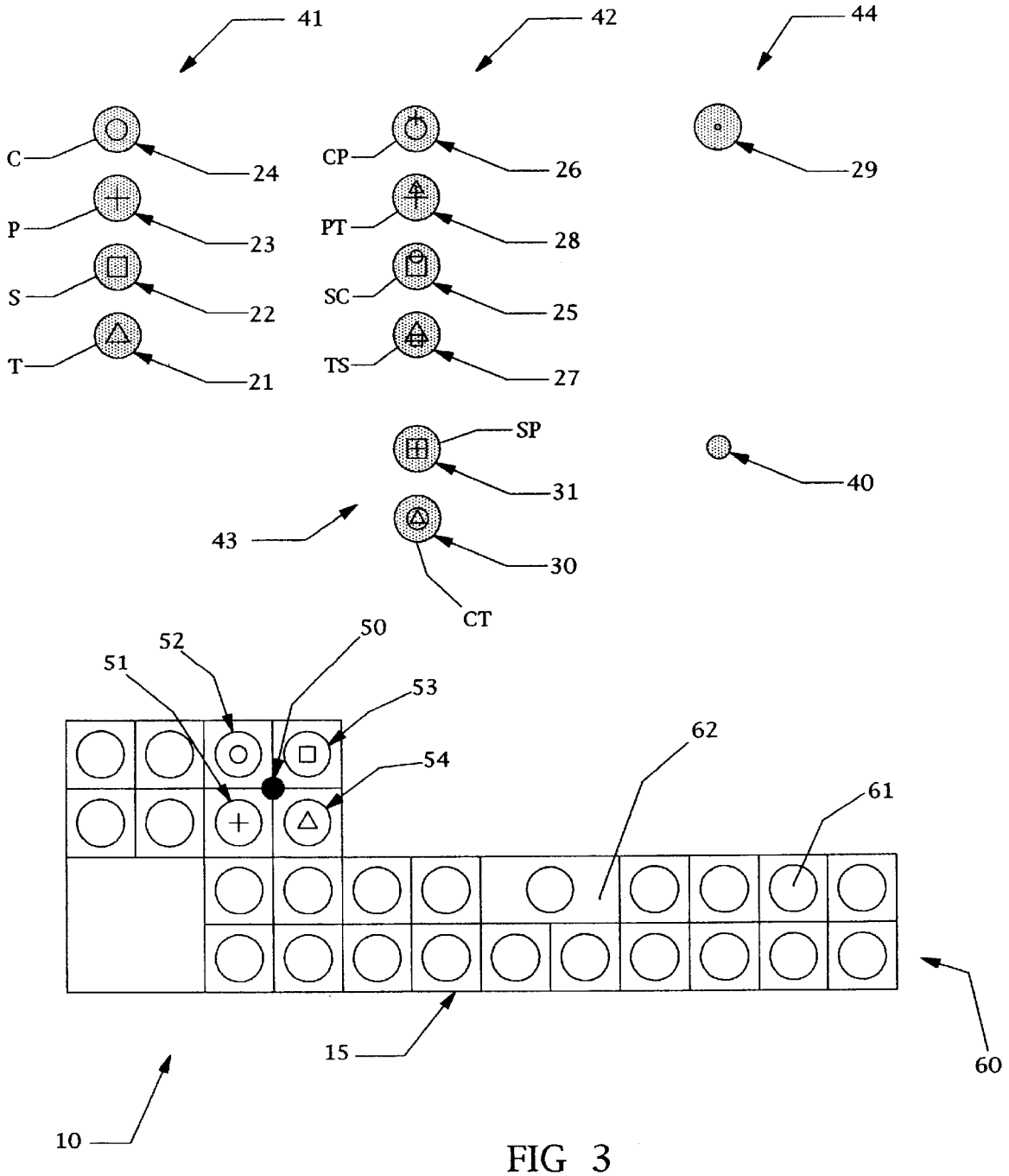
FIG. 3 is an isolated view of a corner of the game board, showing a portion of the perimeter and playing area.
Figure 4:
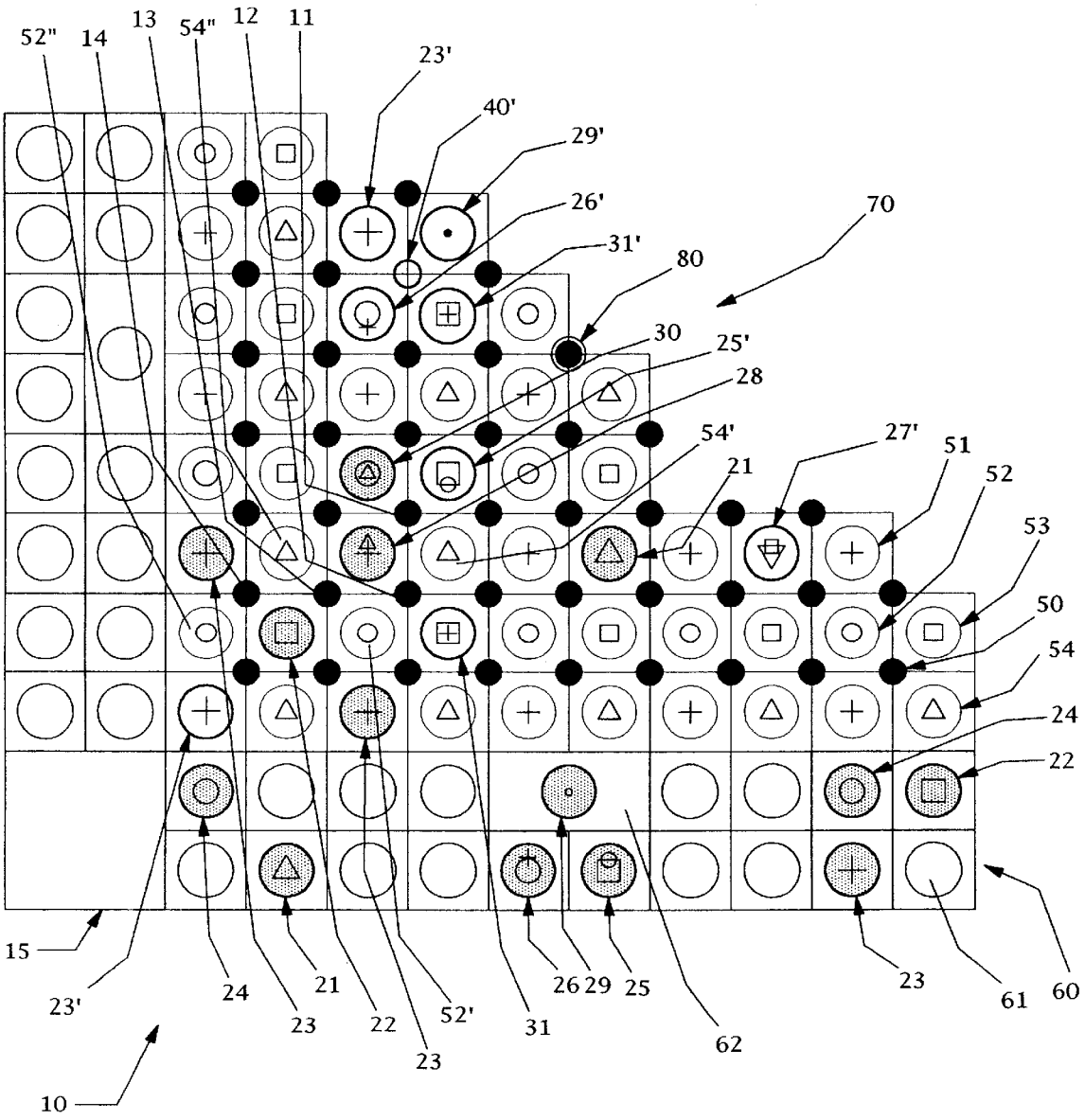
FIG. 4 is an isolated top plan view of a portion of the game board showing the playing pieces positioned on various boxes in the playing area during the course of play of the game.

The playing area further includes a plurality of scoring points 50. Each scoring point 50 is surrounded by four boxes, wherein each box includes a different one of the four identifying elements. As seen in FIGS. 1, 3 and 4, the scoring points 50 are indicated by a solid, dark circle at the intersection of the four corners of the four adjacent boxes.

The playing pieces 20, 30 are preferably of contrasting color such as black and white, respectively. In the preferred embodiment, there are 19 pieces for each player, with four sets of pieces in each group (i.e., S, C, T, P) corresponding with the particular type of movements associated with the identified elements on the playing area. The four types of playing pieces include single pieces 41, combination pieces 42, combination concentric pieces 43, and a multi-directional M pieces 41, as indicated by reference numeral 29 in FIG. 3. The single pieces 41 consist of the basic elements T, S, P, and C as indicated by reference numerals 21–24, respectively. These pieces move in the vertical and horizontal directions and are restricted to movement along the boxes with the corresponding identifying elements. The combination pieces 42 consists of four different combination of elements SC, CP, TS, and PT as indicated by reference numerals 25–28, respectively. These pieces move vertically and horizontally and their movement is restricted along avenues of boxes bearing the corresponding identifying elements. The combination concentric pieces 43 consists of two different combinations of concentric elements CT and SP, indicated by reference numerals 30, 31, respectively. These pieces move diagonally across the board, and their movement is restricted to boxes bearing the corresponding identifying elements. Finally, the multi-directional piece 29 can assume any of the four elements. Its permitted directions of movement included vertical, horizontal and diagonal movement. However, this piece cannot move randomly about the board. Once this piece 29 assumes an element (i.e. S, C, T, or P), if the player decides to change it to another element, it can only be moved to any of the four adjacent elements on the playing area first before it can act as a new element.

Each player is provided with a total of forty one identical scoring pieces. There are forty one black scoring pieces 40' for one player and forty one white scoring pieces 40 for the opposing player. The player who is the last to close the fourth side surrounding a scoring point 50, gains that point and places a scoring piece 40 or 40' on that scoring spot to indicate the scoring of that respective point.

In playing the game, each player can block the avenue (i.e., direction of movement) of its opponent using their playing pieces. Players are not permitted to jump over the opponents player piece with the same element. This technique can be used to strategically create an area on the board where the opponent is unable to infiltrate, thus allowing the player to gain all of the scoring points within that area. Specifically, once a player has blocked his/her opponent from entering an area on the board, that player can simply move his/her player pieces throughout the boxes in that area to surround, and gain, all of the respective scoring points. For example, in FIG. 4, piece 27' is unable to gain spot 54' because piece 21 (PT) is blocking its avenue.

In a situation where a scoring point is surrounded from three sides by three pieces from one player, whereby the opponent has the opportunity to score the point to his advantage by positioning one of his/her pieces on the fourth side, the other player cannot break free from this locked situation by moving his/her piece away from one of the three other boxes. For example, in FIG. 4, piece 25' cannot break free because piece 21 can move into spot 54'. In addition, after scoring each point, the player has to continue scoring points if there are such opportunities.

There is only one situation where the players can lose their pieces. Whenever a piece is surrounded from four sides (three sides along the sides or corners of the playing area) by the opponent's pieces of the same identifying element (i.e., the four avenues of the player are blocked along the four intermediate sides surrounding the player's piece), the surrounded piece is moved out of the game.

Figure 5:
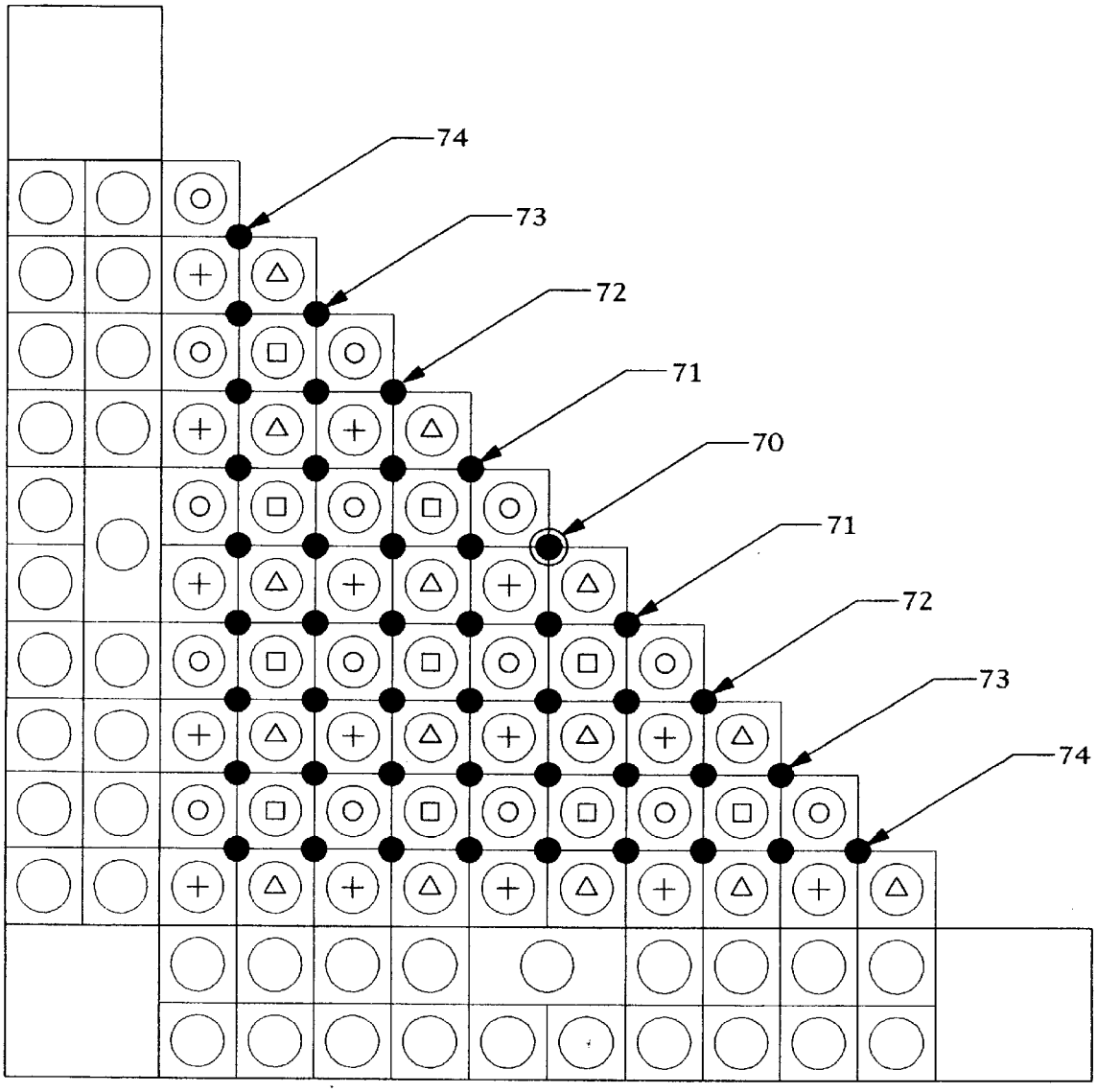
FIG. 5 is an isolated view of one-half of the game board, cut diagonally through the center, demonstrating scoring rows and increasing values of scoring points in each row approaching the center of the game board.

Referring to FIG. 5, a portion of the game board is shown to demonstrate scoring rows 70–74. The scoring values of each row increase towards the center of the game board. Hence, row 70 has the highest scoring value, whereas row 74 has the least scoring value.

Figure 6:
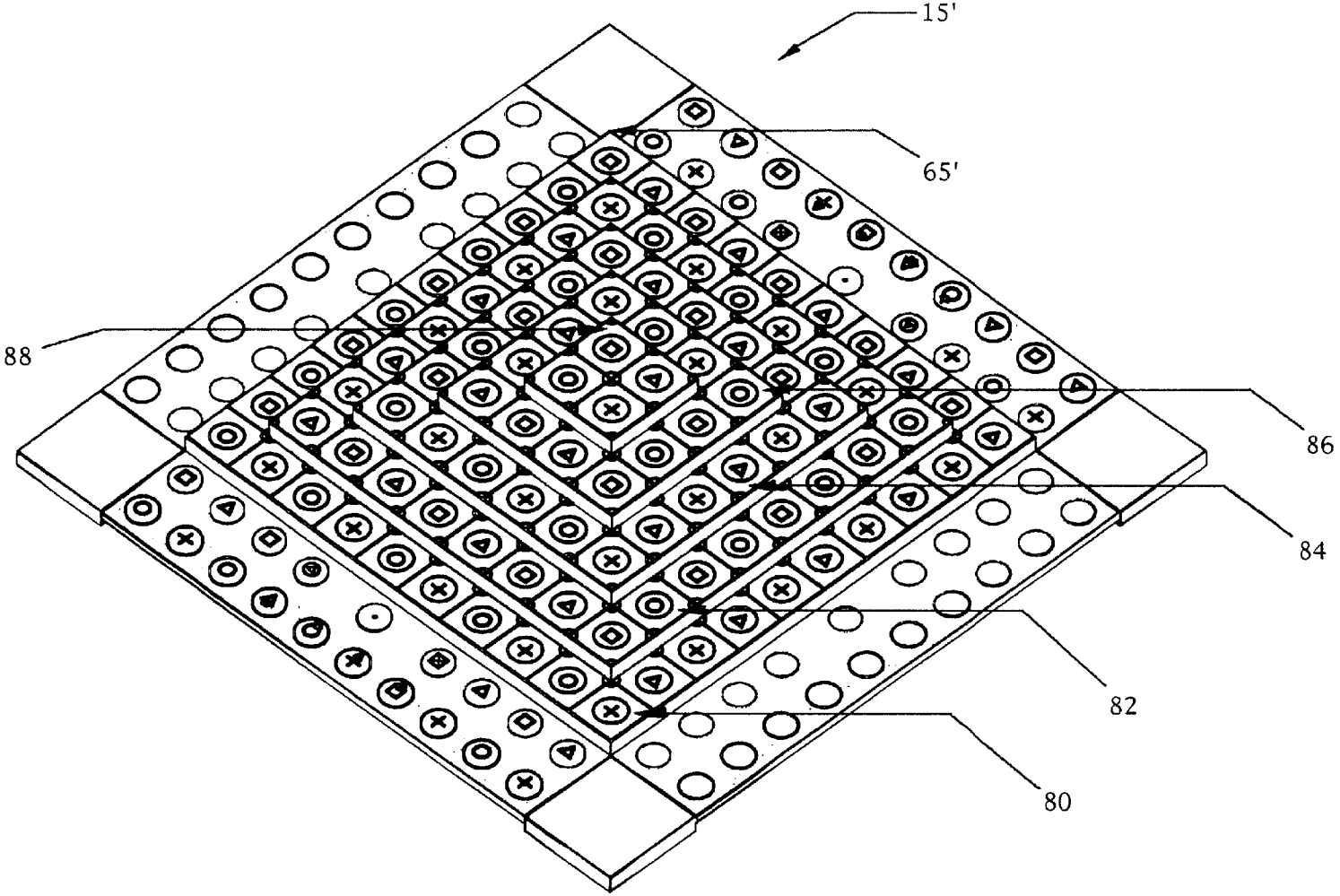
FIG. 6 is a top perspective view of the game board, in accordance with another embodiment thereof, wherein the playing area is structured in a three-dimensional configuration on a plurality of levels, wherein the levels become higher towards the center of the game board.

FIG. 6 illustrates another embodiment of the game board 15' wherein the playing area 65 is constructed in a three-dimensional configuration. Specifically, an outermost perimeter row of boxes 80 is maintained at a first level which is co-planar with a remainder of the outer perimeter of the game board 15'. The next arrangement of boxes, one positioned closer to the center, is provided on a second level 82. A third level of boxes 84 is stepped up beyond the first and second levels 80, 82. Likewise, the fourth level of boxes 86 is again stepped up to a fourth level, while the highest level 88 of boxes, surrounding the center scoring point, defines a fifth level. The stepped arrangement of levels on the playing area 65' defines a generally pyramid-type configuration, wherein each level is provided with four sides of boxes, arranged in columns and rows, in a generally square configuration.

The object of the game is to be the first to score a predetermined number of points, which will be decided before beginning play of the game. Otherwise, the first player to score more than 50% of the total available scoring points, which in the embodiment shown is 41, wins the game. The center point 80 is worth a total of 7 points.

While the instant invention has been shown and described in accordance with a practical and preferred embodiment thereof, it is recognized that departures may be made from the instant disclosure without limitation, except as set forth in the following claims as interpreted under the doctrine of equivalents.

What is claimed is:

1. A game to be played by two or more players comprising:

a board having a perimeter surrounding a playing area, said playing area being divided into equally sized boxes;

a plurality of playing pieces including a plurality of sets of playing pieces for each of the players;

each of said boxes including means for identifying a permitted direction of movement of the playing pieces along horizontal, vertical and diagonal avenues defined by an arrangement of said identifying means within said plurality of boxes;

said playing pieces in each of said sets being of a particular group and having means thereon to identify said group, wherein each group of said playing pieces is assigned a permitted type of directional movement along said avenues on said playing area;

a plurality of scoring points on said playing area, said scoring points being positioned at a juncture of four corners of four of said boxes;

a plurality of scoring pieces for each of the players, said scoring pieces being provided in a plurality of contrasting colors for identifying each of the players, wherein each player is provided with scoring pieces of one particular color;

wherein points are scored by a player when a scoring point is surrounded by three boxes occupied by playing pieces of one or more of the players, and a player enters the fourth box surrounding the scoring point to thereby gain the scoring point; and wherein each of the players places one of their scoring pieces on a scoring point upon gaining that scoring point to indicate points scored by that player.

2. The game as recited in claim 1 wherein said board includes a top surface with said playing area thereon.

3. The game as recited in claim 2 wherein said top surface is coplanar.

4. The game as recited in claim 2 wherein said top surface within said playing area includes multiple planes at different levels.

5. The game as recited in claim 4 wherein said multiple planes of said playing area are structured and arranged in a stepped configuration with an outermost perimeter of said boxes on a first plane being at a lowest level and a center four of said boxes on a last plane being at a highest level.

* * * * *